US006460305B1

(12) United States Patent
VanHaitsma et al.

(10) Patent No.: US 6,460,305 B1
(45) **Date of Patent: *Oct. 8, 2002**

(54) BASEMENT WALL SYSTEM

(75) Inventors: Steve J. VanHaitsma, Grand Rapids, MI (US); Gary Lee Allen, Grand Rapids, MI (US)

(73) Assignee: Steelmasters Inc., Holland, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 381 days.

(21) Appl. No.: 09/033,736

(22) Filed: Mar. 3, 1998

(51) Int. Cl.[7] ..... E04B 2/00

(52) U.S. Cl. ..... 52/483.1; 52/479; 52/408; 52/169.14

(58) Field of Search ..... 52/483.1, 479, 52/283, 309.7, 309.8, 344, 408, 411, 169.14, 293.1, 293.3

(56) References Cited

U.S. PATENT DOCUMENTS

| | | | | | |
|---|---|---|---|---|---|
| 791,775 | A | * | 6/1905 | Hansell | 52/293.3 X |
| 1,062,091 | A | * | 5/1913 | Foster | 52/408 X |
| 1,995,514 | A | * | 3/1935 | Martin | 52/483.1 |
| 2,017,106 | A | * | 10/1935 | Sandell | 52/408 X |
| 2,101,090 | A | * | 12/1937 | Palmer | 52/210 |
| 2,249,799 | A | * | 7/1941 | Trainer | 52/479 |
| 2,433,652 | A | * | 12/1947 | Crom | 52/293.3 X |
| 2,743,602 | A | * | 5/1956 | Dunn | 52/293.3 X |
| 3,323,268 | A | * | 6/1967 | Johnson | 52/483.1 |
| 3,859,766 | A | * | 1/1975 | Flowtow et al. | 52/483.1 X |
| 4,078,347 | A | | 3/1978 | Eastman et al. | |
| 4,222,208 | A | | 9/1980 | Ferver | |
| 4,235,054 | A | | 11/1980 | Cable et al. | |
| 4,263,762 | A | * | 4/1981 | Reed | 52/293.3 |
| 4,310,992 | A | | 1/1982 | Thabet | |
| 4,364,213 | A | * | 12/1982 | Biesanz, Sr. | 52/483.1 X |
| 4,368,604 | A | * | 1/1983 | Spielau et al. | 52/411 X |
| 4,435,934 | A | * | 3/1984 | Kim | 52/483.1 X |
| 4,559,748 | A | | 12/1985 | Ressel | |
| 4,757,651 | A | | 7/1988 | Crites | |
| 4,776,138 | A | * | 10/1988 | Summer et al. | 52/20 |
| 4,805,364 | A | * | 2/1989 | Smolik | 52/483.1 X |
| 4,962,622 | A | | 10/1990 | Albrecht et al. | |
| 5,165,210 | A | * | 11/1992 | Partyka et al. | 52/408 X |
| 5,373,674 | A | * | 12/1994 | Winter, IV | 52/309.9 |
| 5,398,471 | A | * | 3/1995 | Spangnolo | 52/408 X |
| 5,425,207 | A | * | 6/1995 | Shayman | 52/408 X |
| 5,535,556 | A | | 7/1996 | Hughes, Jr. | |
| 5,551,204 | A | | 9/1996 | Mayrand | |
| 5,592,796 | A | * | 1/1997 | Landers | 52/483.1 X |
| 5,653,082 | A | | 8/1997 | Shinoda et al. | |
| 5,657,606 | A | | 8/1997 | Ressel et al. | |
| 5,718,092 | A | * | 2/1998 | Corston | 52/483.1 X |
| 5,732,520 | A | * | 3/1998 | Maietta | 52/438.1 |

* cited by examiner

*Primary Examiner*—Carl D. Friedman
*Assistant Examiner*—Brian E. Geissner
(74) *Attorney, Agent, or Firm*—Price, Heneveld, Cooper, DeWitt & Litton

(57) ABSTRACT

A highly moisture resistant basement wall system which facilitates quick construction includes a plurality of spaced apart metal studs extending vertically upwardly from a sill, and metal decking secured to the plurality of studs. The resulting basement is drier and more comfortable, and warmer in the winter than conventional basements defined by concrete walls.

24 Claims, 2 Drawing Sheets

BASEMENT WALL SYSTEM

FIELD OF THE INVENTION

This invention relates to basement wall systems for buildings and to a method for constructing basement walls for a building, and more particularly to a highly moisture resistant basement wall system which facilitates quick construction.

BACKGROUND OF THE INVENTION

Basement walls for residential buildings have generally been constructed of concrete. Typically, spaced apart vertical forms are assembled at a building site, and concrete is poured into the space defined between the forms. After the concrete has been poured, it must be allowed to set or cure for a period of several days, and often as much as two weeks or even longer. Construction of a building having a poured concrete wall must be completely suspended during the time which the concrete is curing. This delay in construction is undesirable because it usually results in a delay in progress payments and/or final payment to the builder, and can often be associated with reduced profits and/or higher costs.

Another disadvantage with concrete basement walls is that they have a relatively high capacity for absorbing and conveying moisture through capillary action, and, as a result, basements with concrete walls tend to be damp and clammy. This problem cannot be completely overcome by providing the concrete wall with a water resistant barrier coating or layer because moisture can still be transported from the ground through the footing, and into, and through, the concrete walls.

A further disadvantage with concrete basement walls is that they have relatively low thermal insulating properties. As a result, conventional basements having concrete walls tend to be relatively cool and generally uncomfortable during the winter months.

SUMMARY OF THE INVENTION

The present invention provides an improved basement wall system and method for constructing a basement wall of a building, which overcomes the disadvantages of conventional concrete walls. In particular, the basement wall system of the present invention is ready for framing the day after installation, and thus allows relatively rapid construction. A further advantage is that the basement wall systems of the present invention are highly moisture resistant and thus provide a drier and more comfortable basement. Further, the basement walls of the present invention can be easily provided with external and/or internal insulative layers to achieve good insulative properties and provide a basement which is warmer and more comfortable during the winter months.

These and other advantages are achieved with a basement wall comprising a plurality of spaced apart metal studs extending vertically upwardly from a sill, and metal decking secured to the plurality of studs, the studs and decking defining the basement wall.

DESCRIPTION OF THE PREFERRED EMBODIMENTS

Figure 1:
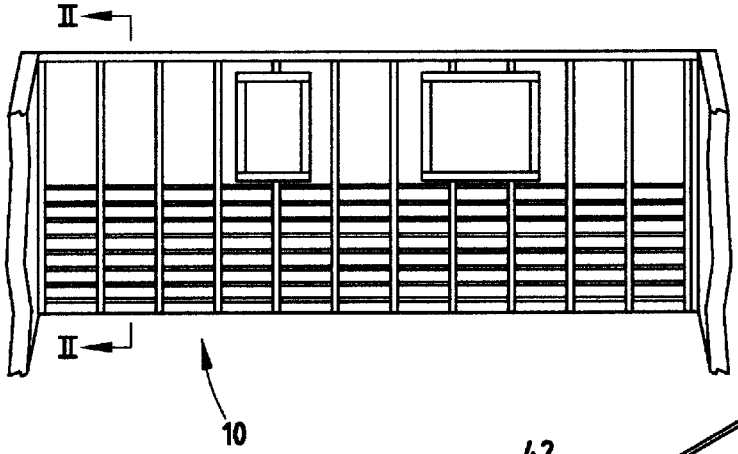
FIG. 1 is a perspective view of a basement wall of a building constructed in accordance with the principles of this invention.
Figure 2:
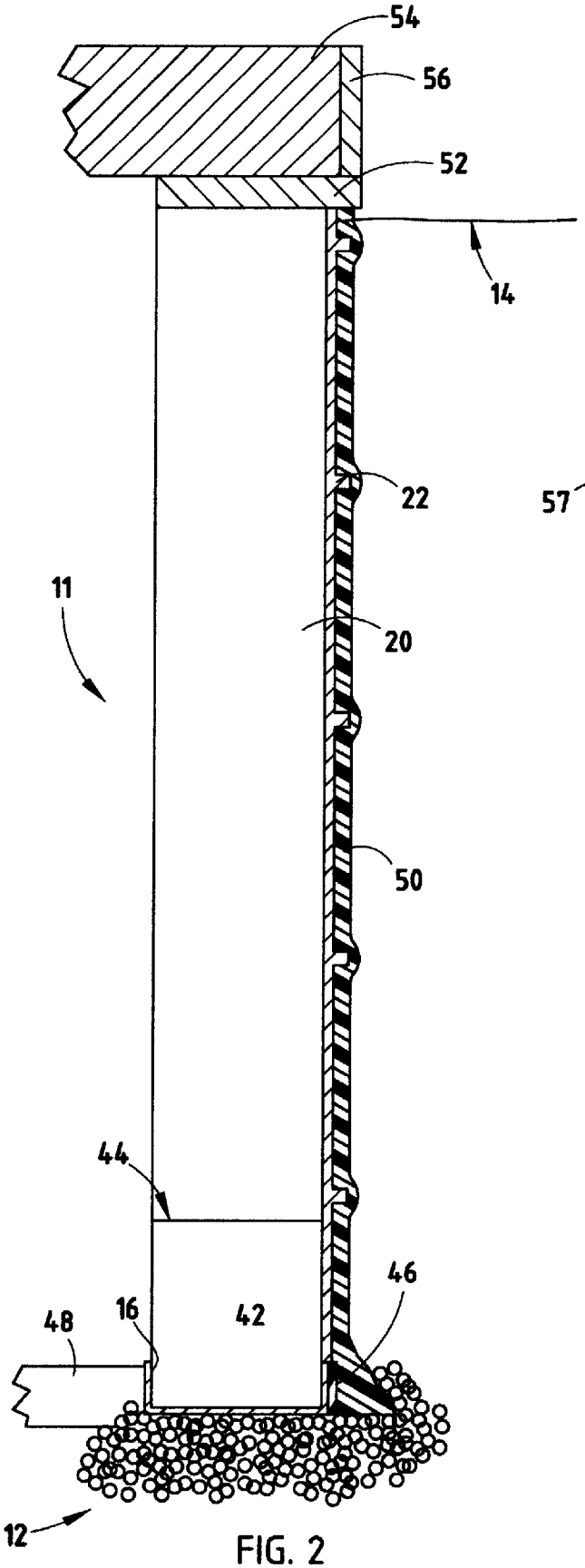
FIG. 2 is an elevational view, in partial cross-section, of the basement wall shown in FIG. 1, as viewed along lines II—II.

A basement wall construction 10 in accordance with the principles of this invention is shown in FIG. 1. A full basement wall 11 is shown in FIG. 2 erected on a footing 12 within an excavation, i.e., below ground level 14. Footing 12 is comprised of compacted pea stones (i.e., stones having a size about equal to or smaller than the size of peas), but can be a conventional concrete footing if desired. In accordance with a preferred aspect of the invention, the wall is transported to the construction site and erected in preassembled sections, for example in 10 to 40 foot long sections which can be easily transported such as on a conventional flatbed trailer.

Figure 5:
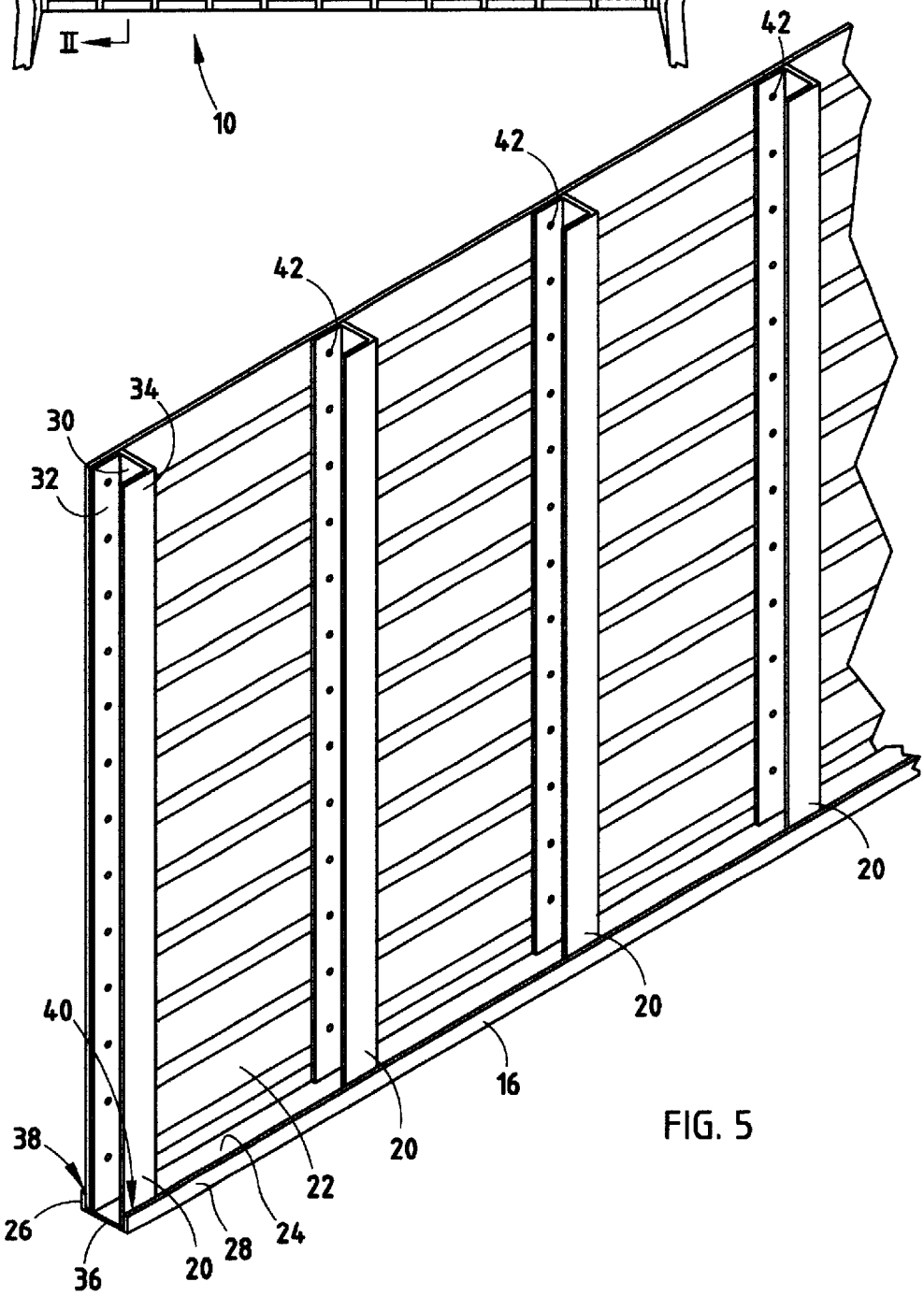
FIG. 5 is a perspective view of a prefabricated section of a basement wall in accordance with the principles of this invention.

As shown in FIG. 5, the prefabricated sections include a metal sill or base 16, a plurality of vertical studs or columns 20, and metal decking 22. Sill 16 has a U-shape channel configuration defining a horizontal base portion 24, an outside vertical flange portion 26, and an inside vertical flange portion 28. Vertical studs 20 are configured to include a web portion 30 which extends along a vertical plane transverse to the length of the basement wall, an outside flange 32 which extends along a plane transverse to the plane of the web, and an inside flange 34 which extends along a plane transverse to the plane of the web. The thickness of studs 20, as measured from the outwardly facing side of flange 32 to the inwardly facing side of flange 34, is approximately equal to the distance between the inwardly facing side of outside flange portion 26 and the outwardly facing side of inside flange portion 28 of sill 16, whereby the lower ends of studs 20 fit snugly between the flange portions of sill 16.

Studs 20 are fixed to sill 16, preferably by welding, such as along the lower edge 36 of web 30 which abuts against base portion 24 of sill 16, and/or at the upper edges 38, 40 of flange portions 26, 28 which abut against the outwardly facing side of flange 32 and the inwardly facing side of flange 34 of studs 20 respectively. Metal decking 22 is secured to studs 30, preferably with fasteners 42, such as screw fasteners or rivets.

Sill 16, studs 20, and decking 22 are preferably made of high construction-grade galvanized steel, although other materials having suitable structural integrity and corrosion resistance may be used. It is also desirable to coat, such as by spraying, all welds with a rust inhibitor. Because the lower portions of a basement wall are somewhat more likely to come in contact with water, the lower portions of the prefabricated sections (as shown in FIG. 5) are preferably provided with a water-resistant coating. For example, after a preassembled section, such as that shown in FIG. 5, is assembled, it may be dipped into a liquid asphalt solution that coats, for example, the bottom 6 inches of the preassembled wall section. The liquid asphalt solution will dry into a high gloss water resistant shell or coating 42 (FIG. 2) which covers and seals sill 16 and the lower portion of studs 20 below line 44 (FIG. 2) to prevent moisture from contacting the metal surfaces of sill 16 and the lower portions of studs 20.

The prefabricated wall sections as described above are transported to a construction site and positioned on a suitable footing 12, with the ends of each wall section abutting an adjacent wall section to form a continuous basement wall. The ends of adjacent sills 16 of adjacent wall sections are preferably connected together. This can be achieved, for example, by welding the abutting edges of adjacent sills 16 along the base portions 24 and/or along the flange portions 26, 28. Alternatively, it is possible to connect the sills 16 of adjacent wall sections by welding or otherwise fastening a suitable metal strap to portions of the adjacent sills, such as with screws or rivets.

In order to enhance the water resistance of the basement walls, and particularly to prevent or inhibit water leakage between the lower portion of the basement walls and the concrete floor of the basement, the sill 16 is preferably wrapped in a waterproof membrane 46 which extends continuously along the outwardly facing side of flange portion 26, the underside of base portion 24 and the inwardly facing side of flange portion 28. The waterproof membrane gives the wall a waterproof bottom surface and a side surface to bond with a foam membrane 50. Suitable waterproof membranes include elastomeric membranes, such as those comprised of natural or synthetic rubber. The thickness of the waterproof membrane is -not particularly critical. However, a suitable thickness for waterproof membrane 46 is, for example, 60 mils.

In many, if not most, cases it may be necessary to brace the walls over the footing until the concrete floor 49 of the basement is poured. Once the concrete floor 49 has been poured, and has set, the basement walls become locked in place, and the bracing, if any, may be removed.

As illustrated in FIG. 2, basement wall 10 is provided with an exterior polymeric foam coating 50. The polymeric foam layer 50 is suitably applied in liquid form and expands after it is applied to the outwardly facing surface of decking 22. Desirably, the foam is applied after the basement wall sections have been abuttingly positioned on footing 12 to provide a seamless membrane or layer around the foundation that both chemically and mechanically bonds to the steel and footing. A suitable foam material which may be applied in liquid form and which expands up to 30 times after it is applied to the outwardly facing side of decking 22 is sold by Foam Enterprises, Inc., Minneapolis, Minn., under the product designation "FE 303-2.0 HC". The FE 303-2.0 HC spray foam when applied to achieve a final foam thickness of approximately 1 inch provides a basement wall which has an insulation rating of R-7. Additionally, if desired, the space between studs 20 on the interior side of decking 22 may be filled with additional insulation, such as additional foam insulation or glass fiber batt.

Generally, within one day after the wall sections comprising sills 16, studs 20 and metal decking 22 have been erected on site and concrete floor 48 has been poured, it is possible to begin framing, e.g., installing wood sill plate 52, floor joists 54, and rim joist 56.

For full basement walls (those in which most or nearly all of the basement wall is below ground level), suitable thicknesses (distance from the outwardly facing side of flange 32 to the inwardly facing side of flange 34) include 6 and 8 inches, with 8 inch studs being preferred for larger residential buildings or buildings having 9 foot basements, and with the 6 inch walls being preferred for smaller residential buildings. For full basement walls, the studs are generally spaced apart by approximately 16 inches, although larger or smaller spacings can be used.

Figure 3:
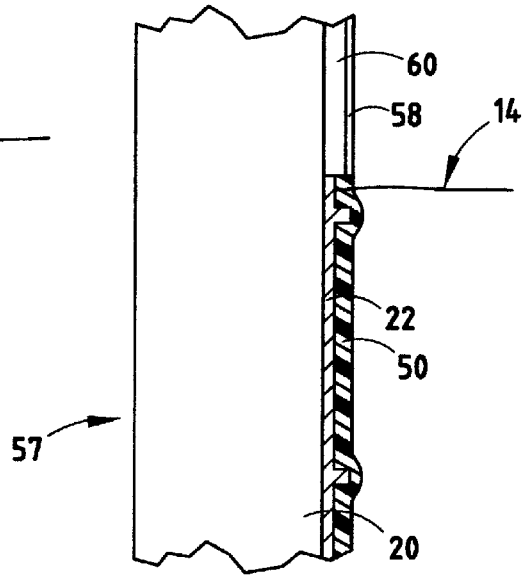
FIG. 3 is a fragmentary, elevational view, in partial cross-section, of a daylight wall of the basement wall system shown in FIG. 1, as viewed along lines III—III.

Shown in FIG. 3 is a daylight wall 57 comprising a lower section which is generally intended to be below ground level 14 and an upper section which is intended to be above ground level. The lower section is generally similar to the previously described full basement walls and includes decking 22 and polymeric foam insulation layer 50. However, the upper portion of the daylight wall includes an outer polymeric foam board such as oriented strand board (OSB) layer 58 secured to the studs and extending along the upper section of the daylight wall 57 and an expanded polystyrene (EPS) foam layer 60 secured to the polymeric foam board in a face-to-face relationship. The daylight walls have a height equal to that of the full wall, but commonly have studs spaced about 24 inches apart, although greater or smaller spacings are possible. The larger spacing of the stud for the daylight walls as compared with the full basement walls is on account of the fact that the daylight walls are expected to only carry part, usually about half, of the earth load which a full wall is expected to carry. The daylight walls are generally less expensive to make and can therefore be sold at a lower cost than the full basement walls. The daylight walls can be provided with any number of windows as desired.

Figure 4:
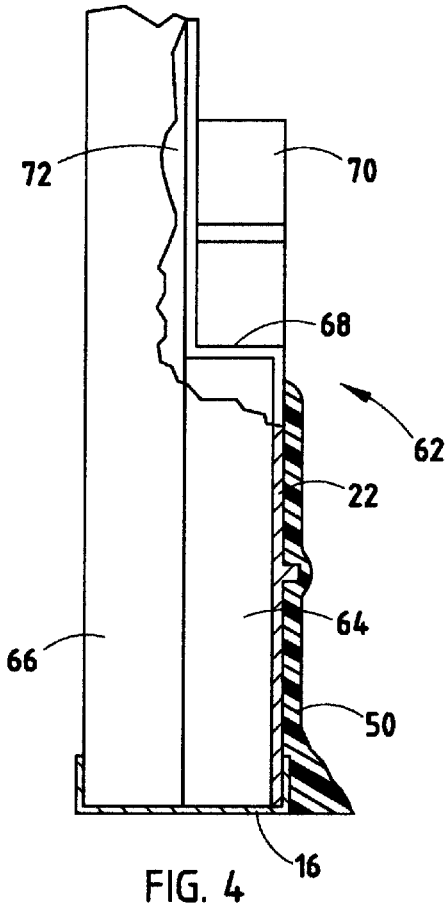
FIG. 4 is a fragmentary, elevational view, in partial cross-section, of a brick ledge wall in accordance with the principles of the present invention.

Shown in FIG. 4 is a brick ledge basement wall 62. The brick ledge wall is comprised of two metal studs 64 and 66 which work together like a single stud having twice the thickness of the individual studs. For example, short studs 64 and tall studs 66 can each be 4 inch thick studs which act together like an 8 inch stud. Studs 64 and 66 are connected together with their flanges abutting. Studs 64 and 66 can be secured together such as by welding, or with fasteners such as screws or rivets. Studs 64 and 66 extend upwardly from sill 16 in a manner generally identical to that described with respect to the full basement wall illustrated in FIG. 2. As with the daylight walls, decking 22 only extends along the lower portion of brick ledge walls 62. At the height at which the upper end of decking 22 terminates, a brick ledge 68 is secured to studs 64, 66 to provide a bearing surface upon which a brick facade 70 may be constructed. The use of two connected studs (64 and 66) in place of a single stud, allows one stud to carry the brick veneer 70 and the other to carry the floor and roof loads.

Installation of the daylight walls and brick ledge walls is substantially identical with the installation procedure described above for the full basement walls. However, with the daylight walls, the foam insulation layer 48 is only provided over the lower portion of the wall, i.e., the exterior face of decking 22. Likewise, with the brick ledge walls, insulating layer 48 is applied to the exterior surface of decking 22. However, it is also desirable to apply an insulating polymeric foam layer 72 along the interior side of ledge 68 as shown in FIG. 4 to provide a continuous water and thermal insulating barrier.

In the illustrated embodiments, installation of the basement wall system of this invention has been described with reference to erecting the basement wall system on a pea stone footing. However, a concrete footing can be used as well. In the case where a concrete footing is used, it may be desirable to eliminate the water resistant membrane 46, and instead position an asphalt impregnated fibrous mat (such as 30# felt paper) between the concrete footing and the underside of sill 16.

Although installation of the basement wall of the present invention has been described primarily with reference to the use of prefabricated wall sections which are transported to and erected at a construction site, it is of course possible to install sill 16 onto a footing and construct the wall on-site to achieve many of the advantages described herein, without departing from certain principle aspects of the invention.

In addition to being ready for framing the day after installation and thereby facilitating rapid construction, and providing an insulating rating of R-12, the basement walls of the invention meet the Federal Energy Star Program. Further, only limited interior basement framing is needed, also allowing quicker construction. The resulting basement defined by the basement walls of this invention provides a living room quality environment, with no ugly, half-concrete walls showing in daylight rooms. The basement walls of the invention also provide dry multi-use areas, and because the metal wall structure does not absorb or transport moisture like concrete, and includes an exterior water-resistant, insulative layer, there is no damp, clammy feel. Another advantage with the basement walls of this invention is that the completed cost is approximately 25% less than the cost of concrete basement walls.

While the invention has been described in detail with respect to various specific embodiments of the invention, various alternatives, modifications and equivalents may be used. Therefore, the above description should not be taken as limiting the scope of the invention, which is defined by the appended claims.

What is claimed is:

1. A building basement, comprising:

a basement floor; and an adjacent basement wall extending upwardly; the basement wall including a sill, a plurality of spaced apart metal studs extending vertically upwardly from the sill, and metal decking secured to the plurality of studs, the basement wall and basement floor defining a habitable basement.

2. The basement wall of claim 1 wherein the studs are fixed to the sill.

3. The basement wall of claim 1 wherein the studs are welded to the sill.

4. The basement wall of claim 1 wherein the metal decking is secured to the studs with screw fasteners or rivets.

5. The basement wall of claim 1 wherein the sill, studs and decking are made of galvanized steel.

6. The basement wall of claim 1 wherein a lower portion of the basement wall is provided with a water-resistant coating.

7. The basement wall of claim 6 wherein the water-resistant coating is applied by dipping the basement wall in a water-resistant coating solution.

8. The basement wall of claim 1 which is erected on a footing within an excavation.

9. The basement wall of claim 8 wherein a polymeric foam layer is provided on an exterior side of the decking.

10. The basement wall of claim 9 wherein the polymeric foam layer is approximately 1 inch thick, and wherein the basement wall achieves an insulation rating of R-7.

11. The basement wall of claim 1 wherein the sill has a U-shape channel configuration defining a horizontal base portion, and outside vertical flange portion, and an inside vertical flange portion.

12. The basement wall of claim 11 wherein the vertical studs are configured to include a web portion which extends along a plane transverse to the length of the basement wall, an outside flange which extends along a plane transverse to the plane of the web, and an inside flange which extends along a plane transverse to the plane of the web.

13. The basement wall of claim 12 wherein the thickness of each of the plurality of vertical studs, as measured from an outwardly facing side of the outside flange of the stud to the inwardly facing side of the inside flange of the stud, is approximately equal to the distance between the inwardly facing side of the outside flange portion of the sill and the outwardly facing side of the inside flange portion of the sill, whereby lower ends of the studs fit snugly between the flange portions of the sill.

14. The basement wall of claim 1 further comprising a seamless polymeric foam membrane bonded to an exterior side of the decking.

15. A basement wall for a building, the basement wall being erected on a footing within an excavation, comprising:

a sill;

a plurality of spaced apart metal studs extending vertically upwardly from the sill;

metal decking secured to the plurality of studs; and a waterproof membrane disposed between the sill and the footing, the waterproof membrane extending continuously along an underside of the sill.

16. The basement wall of claim 15 wherein the waterproof membrane is made of an elastomeric material.

17. The basement wall of claim 16 wherein the elastomeric material is comprised of synthetic or a natural rubber.

18. The basement wall of claim 16 wherein the waterproof membrane has a thickness of about 60 mils.

19. A basement wall for a building comprising:

a sill:

a plurality of spaced apart metal studs extending vertically upwardly from the sill;

metal decking secured to the plurality of studs, wherein the decking extends along a lower portion of the basement wall; and wherein the basement wall further comprises an upper portion including a polymeric foam board secured to the studs and extending along the upper portion, and an oriented strand board secured to the polymeric foam board in a face-to-face relationship.

20. A basement wall for a building, comprising:

a sill;

a plurality of spaced apart short metal studs extending vertically upwardly from the sill;

metal decking secured to the plurality of short metal studs, the decking extending along a lower portion of the basement wall;

a plurality of tall metal studs having a height greater than the plurality of short metal studs, each of the tall studs extending vertically upwardly from the sill and being connected to a corresponding one of the short studs; and a brick ledge secured to upper ends of the short studs to provide a bearing surface upon which a brick facade may be disposed.

21. A building comprising a habitable basement defined by a basement wall and a basement floor, the basement -wall comprising a sill, a plurality of spaced apart metal studs extending vertically upwardly from the sill, and metal decking secured to the plurality of studs.

22. The building of claim 21, wherein the basement wall defines a habitable basement which is about 9 feet high.

23. The building of claim 21, wherein a waterproof membrane is disposed between the sill and the footing, the waterproof membrane extending continuously along the underside of the sill.

24. The building of claim 21 further comprising a seamless polymeric foam membrane bonded to an exterior side of the decking.

* * * * *